US006761156B2

(12) United States Patent
Zarkhin et al.

(10) Patent No.: US 6,761,156 B2
(45) Date of Patent: Jul. 13, 2004

(54) MULTIPLEXED SINGLE WIRE CONTROL AND DIAGNOSIS OF AN ELECTRICAL OBJECT

(75) Inventors: Mikhail Zarkhin, West Bloomfield, MI (US); Michael S Boggess, Harrison Township, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/371,252

(22) Filed: Feb. 20, 2003

(65) Prior Publication Data

US 2003/0168049 A1 Sep. 11, 2003

Related U.S. Application Data

(60) Provisional application No. 60/358,128, filed on Feb. 2, 2002.

(51) Int. Cl.[7] ..... F02P 9/00; F02P 3/045

(52) U.S. Cl. ..... 123/609; 123/644; 123/652

(58) Field of Search ..... 123/609, 610, 123/611, 644, 652

(56) References Cited

U.S. PATENT DOCUMENTS

| | | | | | |
|---|---|---|---|---|---|
| 5,490,489 | A | * | 2/1996 | Mayer et al. | 123/630 |
| 6,085,144 | A | | 7/2000 | Tozzi | 701/114 |
| 6,100,728 | A | * | 8/2000 | Shreve et al. | 327/110 |
| 6,216,678 | B1 | * | 4/2001 | James et al. | 123/594 |
| 6,668,811 | B1 | * | 12/2003 | Kesler | 123/644 |

* cited by examiner

*Primary Examiner*—Hai Huynh
(74) *Attorney, Agent, or Firm*—Edwin W. Bacon, Jr.

(57) ABSTRACT

An ignition coil assembly for providing ignition energy to a spark plug in accordance with a dwell pulse and transmitting diagnostic data related to an ignition event occurring after the dwell pulse. The assembly has an ignition coil with a spark plug terminal adapted to mate with the spark plug, and a transistor for conducting current flow through the primary winding of the ignition coil. The current flow is in accordance with the dwell pulse, which arrives over a signal line. A diagnostic block receives at least one electrical signal from the ignition coil and derives diagnostic data therefrom for transmitting over the same signal line in the absence of the dwell pulse.

17 Claims, 4 Drawing Sheets

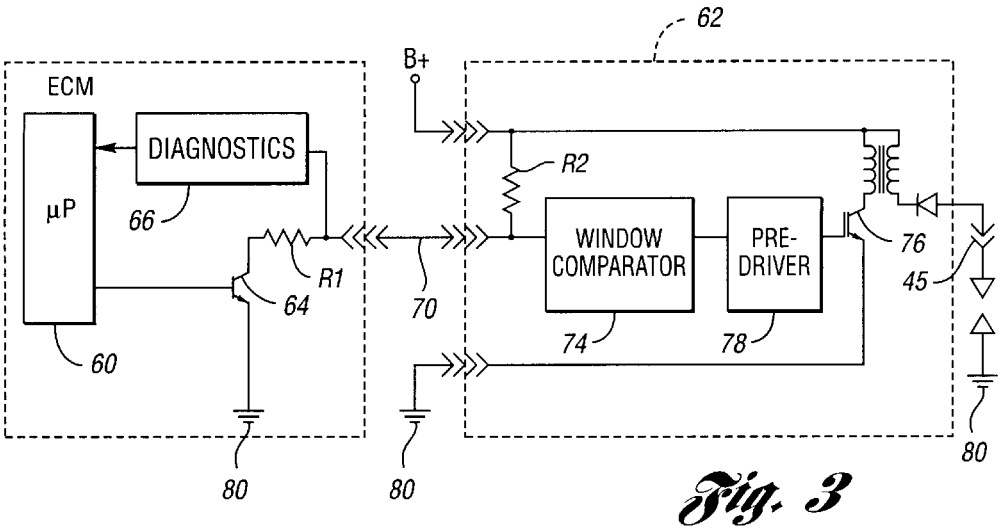
Fig. 3
Fig. 5
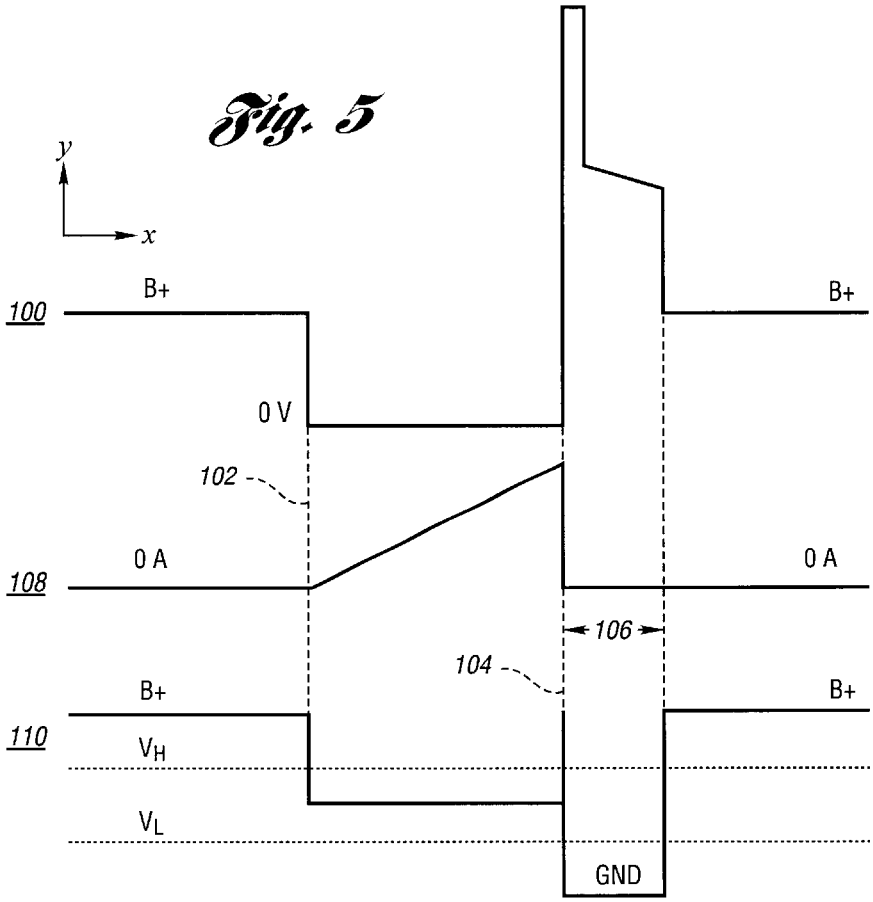

MULTIPLEXED SINGLE WIRE CONTROL AND DIAGNOSIS OF AN ELECTRICAL OBJECT

CROSS-REFERENCES TO RELATED APPLICATIONS

This application claims the benefit of U.S. Provisional Application Serial No. 60/358,128, filed Feb. 2, 2002.

FIELD OF INVENTION

This invention relates generally to diagnostic and control channels for electrical components. More particularly, this invention relates to multiplexing an ignition coil circuit node to perform a diagnostic function and a control function.

BACKGROUND

Gasoline internal combustion engines now commonly use a single ignition coil for each cylinder. The ignition coil is frequently configured for mounting directly atop a spark plug screwed into the cylinder head. Such an ignition coil arrangement is commonly known as a coil-on-plug arrangement.

A power transistor within an engine control module (ECM) generally conducts current flow through the primary winding of an ignition coil during a dwell period, after which the spark plug fires. The ECM also generally contains a microprocessor that executes software to diagnose the performance of the ignition coil. This diagnosis is commonly performed by measuring the voltage across the power transistor, which is representative of the voltage across the primary winding of the ignition coil and indicative of ignition system performance.

The ECM power transistor develops heat, however, making it desirable to locate the power transistor outside of the ECM and away from the microprocessor. A common location for the power transistor is on the ignition coil where it is in close proximity to the primary winding. Such an arrangement presents at least two new problems, however. The first problem lies in the course of events should the control wire to the power transistor become shorted to a high or low voltage source, such as battery or ground, respectively. Without additional circuitry, either the ECM, the power transistor, or both, could become damaged and unserviceable by excessive current flow and power dissipation.

The second problem lies with reliably diagnosing performance of the ignition coil. A solution to the diagnostic problem has heretofore required diagnostic wiring, additional to the control line for sending a dwell pulse to the power transistor, to be connected between the ECM and the ignition coil/power transistor assembly (hereinafter referred to as an ignition coil assembly). The additional wiring carries an electrical signal from ignition coil assembly back to the ECM so that it may perform diagnostics on the assembly and its performance. This additional diagnostic wiring creates added expense through higher connector pin counts and added conductors. The additional wiring also increases the risk of system failure by failed connections.

SUMMARY

It is therefore one aspect of the invention to provide an ignition coil assembly having an integrated driver where serviceability of the assembly is tolerant of a driver control line being short circuited.

It is yet another aspect of the invention to provide an ignition coil assembly having a common signal line for both a dwell pulse and diagnostic information.

In accordance with the aforementioned aspects, the present invention provides an ignition coil assembly for providing ignition energy to a spark plug in accordance with a dwell pulse and transmitting diagnostic data related to an ignition event occurring after the dwell pulse. The assembly has an ignition coil with a spark plug terminal adapted to mate with the spark plug, and a transistor for conducting current flow through the primary winding of the ignition coil. The current flow is in accordance with the dwell pulse, which arrives over a signal line. A diagnostic block receives at least one electrical signal from the ignition coil and derives diagnostic data therefrom for transmitting over the same signal line in the absence of the dwell pulse.

BRIEF DESCRIPTION OF THE DRAWINGS

The present invention will become more fully understood from the detailed description and the accompanying drawings, wherein:

FIG. 3 depicts a single wire system with window comparator,

FIG. 5 depicts waveforms of the circuit of FIG. 4.

DETAILED DESCRIPTION

The following description is merely exemplary in nature and is in no way intended to limit the invention, its applications, or uses.

Figure 1:
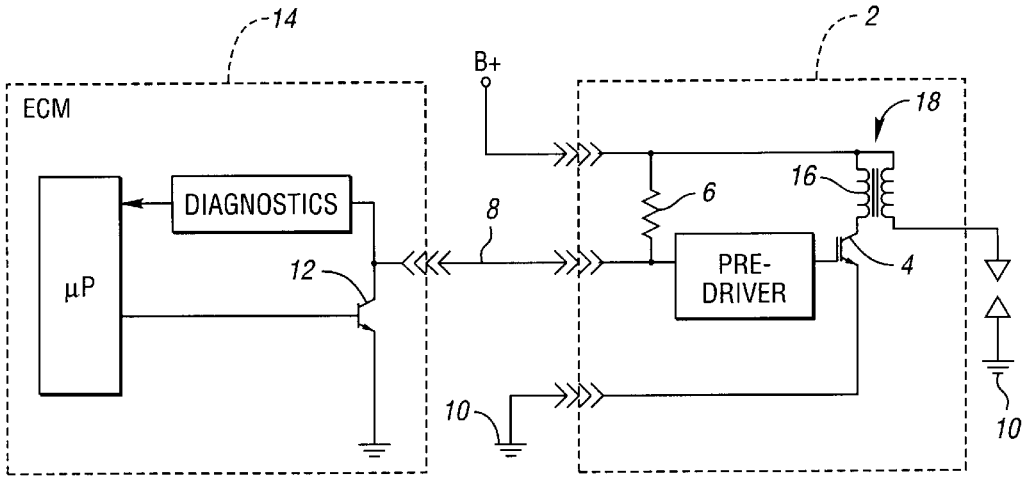
Fig. 1 (PRIOR ART)
FIG. 1 depicts a single wire control-only circuit of the prior art.

Open collector (or drain in the case of a field effect transistor) output is a common method for interfacing the output of an ECM to a load with an integrated power driver. FIG. 1 shows such an interface used with an ignition coil assembly 2 having an integrated driver transistor 4.

While the prior-art interface of FIG. 1 has the advantages of low cost and simplicity in design, it also suffers from inherent weaknesses. Once such weakness relates to control lead 8 becoming undesirably shorted to either battery voltage B+ or to ground 10. If control lead 8 is shorted to B+, the output driver 12 of the ECM 14 will pass unimpeded current to ground 10 and will likely fail. Similarly, should the control lead 8 become shorted to ground 10, the driver transistor 4 will turn on unintentionally and pass unimpeded current to ground 10 through the primary winding 16 of ignition coil 18. In this aspect, either the ignition coil 18 or driver transistor 4, or both, may be damaged by the unintended current flow.

Another inherent weakness of the interface of FIG. 1 is the limited ability of the microprocessor to diagnose the performance of the system. In this arrangement, the microprocessor may be limited to diagnosing the operation of output driver 12 and be unable to diagnose the operation of ignition coil assembly 2 or electrical characteristics of dwell and ignition.

Figure 2:
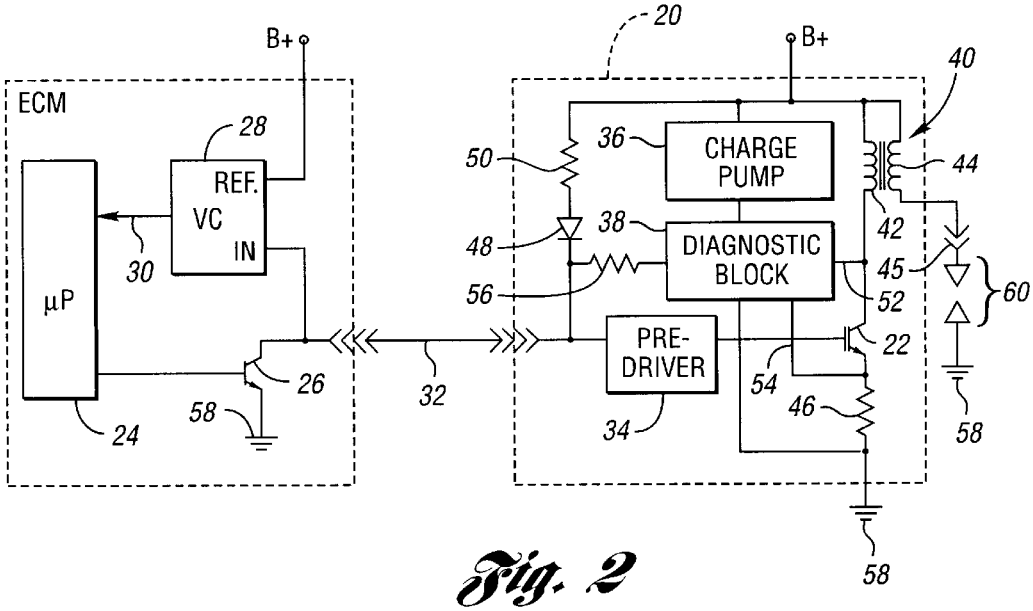
FIG. 2 depicts a multiplexed single wire system with voltage multiplier.

Turning now to FIG. 2, an aspect of a first improved ignition coil assembly 20 is shown in combination with an ECM. A microprocessor 24 executes software for controlling and diagnosing the performance of an ignition coil assembly 20. The microprocessor 24 has an output for controlling an output driver 26 and an input for receiving a diagnostic signal from a voltage comparator 28. Comparator 28 is referenced to battery supply, B+, and receives an input signal from multiplexed (MUX) signal line 32, which is also connected to the collector of output driver 26.

The MUX signal line 32 connects to ignition coil assembly 20. Assembly 20 has an integral driver transistor 22 that is controlled by a pre-driver 34. The input to pre-driver 34 is pulled-up by pull-up resistor 50 through diode 48. Transistor 22 passes current that travels from B+, through the primary winding 42 of coil 40, and then through shunt resistor 46. A charge pump 38 produces a voltage greater than B+ and powers a diagnostic block 38 therewith. Diagnostic block 36 has a voltage measuring input 52, or current measuring input 54, or both, for detecting electrical signals of the primary winding 42. The diagnostic block 38 sends diagnostic information to the ECM through MUX signal line 32. A series resistor 56 may be used to protect the diagnostic block output from excessive current flow. Diode 48 operates to prevent the diagnostic block output from coupling to the charge pump 36.

In operation, MUX signal line 32 carries control and diagnostic data. The microprocessor 24 begins dwell by sending a dwell pulse via output driver 26, thereby pulling the MUX signal line 32 down to ground 58 potential for the duration of the pulse. With the MUX signal line 32 pulled low, the pre-driver 34 turns on driver transistor 22, thereby allowing dwell current to begin to flow from B+, through the primary winding 42, the driver transistor 22, and, if used, the shunt resistor 46. The diagnostic block 38 determines diagnostic current information from a signal at current input 54. While coil 40 is in dwell, the MUX signal line 32 is pulled near ground 58, momentarily precluding the transfer of diagnostic data over the line 32.

Once the coil 40 has been in dwell for the desired duration of the dwell pulse, the microprocessor 24 turns off output driver 26, allowing MUX control line 32 to be pulled to B+ by pull-up resistor 50. With the MUX control line 32 potential at B+, pre-driver 34 turns off driver transistor 22, thereby stopping current flow through the primary winding 42. A high voltage is created in the secondary winding 44 when the current through the primary winding is turned off, thereby causing a spark across the gap between spark plug electrodes 60. The spark plug is connected to the secondary winding 44 via a terminal 45 adapted to mate with the spark plug 60. The high voltage is reflected from the secondary 44 to the primary winding 42, and attenuated by a turns ratio of the ignition coil 40. The diagnostic block 38 detects the reflected voltage at voltage input 52 and determines diagnostic voltage information therefrom. This diagnostic information may also include spark-pulse duration, or burn time, information determined from the reflected voltage. The output driver 26 is off in the absence of the dwell pulse and the diagnostic block 38 transmits diagnostic information over the signal line 32 during the absence. The information is encoded as pulsed data, with pulses having a high voltage approximately equal to the output voltage of the charge pump 36. Voltage comparator 28, which is connected to the signal line 32, receives these pulses. The output 30 of the voltage comparator produces a digital pulse, compatible with the microprocessor 24, for each period the voltage of the signal line 32 exceeds the reference voltage (B+ in this example) of comparator 28. The digital pulses are representative of the diagnostic pulses sent by the diagnostic block 28. Since both the voltage comparator 28 and charge pump 36 are referenced to B+, signals sent from the diagnostic block 38 may be resolved by the voltage comparator 28 regardless of the magnitude of B+.

Moving to FIG. 3, an aspect of a second improved single-wire system is shown. A microprocessor 60 executes software for controlling the performance of an ignition coil assembly 62. The microprocessor 60 has an output for controlling an output driver 64 and an input for receiving diagnostic information from a diagnostic interface circuit 66. This diagnostic interface circuit 66 is application specific and operates to shift the voltages on signal line 70 to voltages compatible with the input of microprocessor 60. A resistor R1, in series with the collector of the output driver 64, operates, in part, to limit current through the driver 64 in the event signal line 70 becomes shorted to B+. Resistor R1 also operates in conjunction with resistor R2 to create a voltage divider having the signal line 70 at the voltage divider tap.

The signal line 70 operates to provide a dwell pulse to a window comparator 74. The window comparator turns on driver transistor 76, via predriver 78, when the voltage across the signal line 70 is within upper and lower voltage thresholds of window comparator 74. When output driver 64 is turned on, the voltage across the signal line 70 is approximated by the equation $$V_s = V_{batt} * R_1/(R_1+R_2) \quad \text{Eq. 1}$$

where $V_s$=voltage of signal line 70 with respect to ground 80, $V_{batt}$=B+ in volts, $R_1$=ohmic value of resistor R1, and $R_2$=ohmic value of resistor R2.

The upper and lower voltage thresholds of the window comparator 74 may be set such that $$V_H = V_S + \text{Delta1} \quad \text{Eq. 2}$$

and $$V_L = V_S - \text{Delta2} \quad \text{Eq. 3}$$

where $V_H$=upper voltage threshold of window comparator 74, $V_L$=lower voltage threshold of window comparator 74, Delta1=positive voltage, and Delta2=positive voltage<$V_s$.

The resistors R1 and R2 may be simply set equal to each other so that the signal line 70 is at $V_{batt}/2$ while the output driver 64 is turned on. The window comparator 74 thresholds, $V_H$ and $V_L$, may simply be set ratiometrically to B+. For example, $V_H = 2V_{batt}/3$ and $V_L = V_{batt}/3$.

The circuit of FIG. 3 advantageously operates to protect output driver 64 when signal line 70 is shorted to either B+ or ground 80. As mentioned previously, the output driver 64 is protected by R1 when signal line 70 is shorted to B+. The circuit also advantageously operates to protect the ignition coil assembly 62 when signal line 70 is shorted to ground. Such protection is achieved by the voltage of the signal line 70 being outside of the voltage thresholds of window comparator 74. Since the signal line voltage is outside of the thresholds, the window comparator turns off the driver transistor via predriver 78 thereby precluding unintended current flow through the driver transistor 76 and its associated primary winding of the ignition coil.

Figure 4:
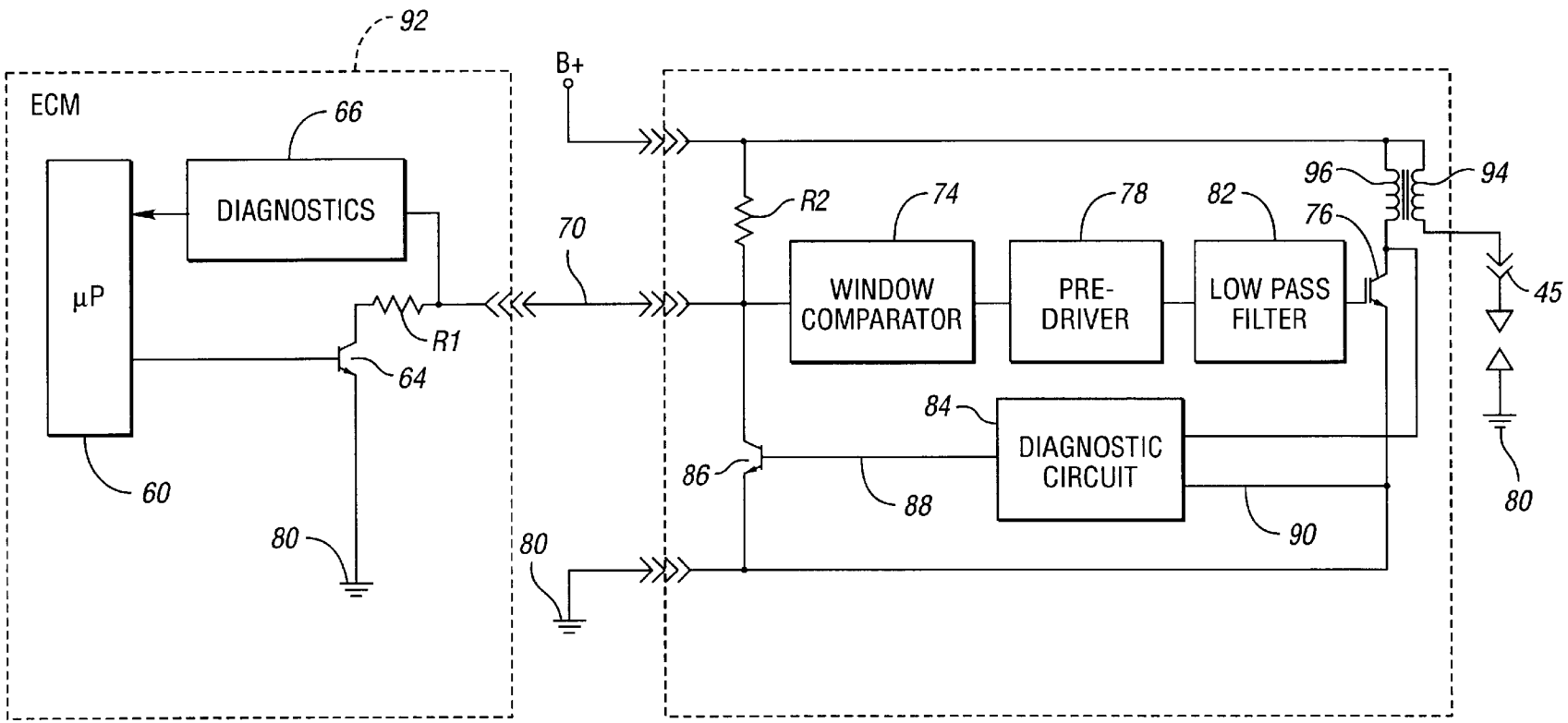
FIG. 4 depicts a multiplexed single wire system with window comparator and low-pass filter.

Turning now to FIG. 4, an aspect of a third improved single-wire multiplexed system is shown. In addition to the functionality of the circuit of FIG. 3, the circuit of FIG. 4 adds the capability of transmitting diagnostic information back to the ECM 92. A diagnostic circuit 84 has a voltage input 90 and a diagnostic output 88. The diagnostic circuit 84 may also have a current input arrangement similar to the circuit of current input 54 shown in FIG. 2. The voltage input 90 detects voltage reflected through the ignition coil (as discussed earlier) and determines diagnostic voltage information therefrom. This diagnostic information may also include spark-pulse duration information as determined from the reflected voltage. Similarly, the diagnostic circuit may determine diagnostic current information from a current input, if so equipped.

The diagnostic circuit transmits the diagnostic information over the signal line 70 while the output driver 64 is turned off. The diagnostic circuit transmits the information by turning on transmit transistor 86, which pulls the signal line 70 to ground 80 potential, thereby sending information data.

Signal line 70 voltage rises to B+ when transmit transistor 86 turns off. During this voltage rise, however, the voltage passes through the voltage thresholds of window comparator 74, thereby possibly causing the window comparator to inadvertently attempt to turn on the driver transistor 76. Low-pass filter 82 may be placed between the window comparator 74 and driver transistor 76 to prevent transistor 76 from turning on during this transient voltage rise. Similarly, the low-pass filter prevents the transistor 76 from turning on while the voltage of signal line 70 passes though the window comparator voltage thresholds as it decreases from B+ to ground 80 potential.

The circuit of FIG. 4 may be better understood by referring to the time-correlated waveforms of FIG. 5. The y-axis of traces 100 and 110 represent voltage, whereas the y-axis of trace 108 represents current flow through the primary winding 96 of the ignition coil 94. The x-axis represents time. Trace 110 shows the voltage of the signal line 70 during one cycle of firing the spark plug. Prior to start of dwell 102, signal line 70 is pulled up to B+ by resistor R2. During this time, the driver transistor 76 is off because the signal line 70 voltage is outside of window comparator voltage thresholds $V_H$ and $V_L$. Trace 100 represents the voltage at the collector of driver transistor 76 and shows that the collector is at B+ while the driver transistor 76 is off. At the start of dwell 102, output driver 64 is turned on, thereby bringing the control line 70 voltage within the comparator voltage thresholds. The window comparator 74 then causes driver transistor 76 to turn on as indicated by drop in voltage of trace 100 and the rise in current of trace 108. The current continues to rise until the end of dwell 104. At the end of dwell 104, output driver 64 is turned off as evidenced by the control line 70 voltage going to B+. Control line 70 stays at B+ after the dwell pulse until the diagnostic transmit transistor 86 pulls the control line low to send diagnostic information back to the diagnostic interface circuit 66. In trace 110, the diagnostic information is a low pulse representative of the burn time 106 of the spark event. The low-pass filter 82 prevents the driver transistor 76 from turning on while the control line 70 passes through the voltage threshold window at the end of dwell 104 and during switching transitions of the transmit transistor 86.

Figure 6:
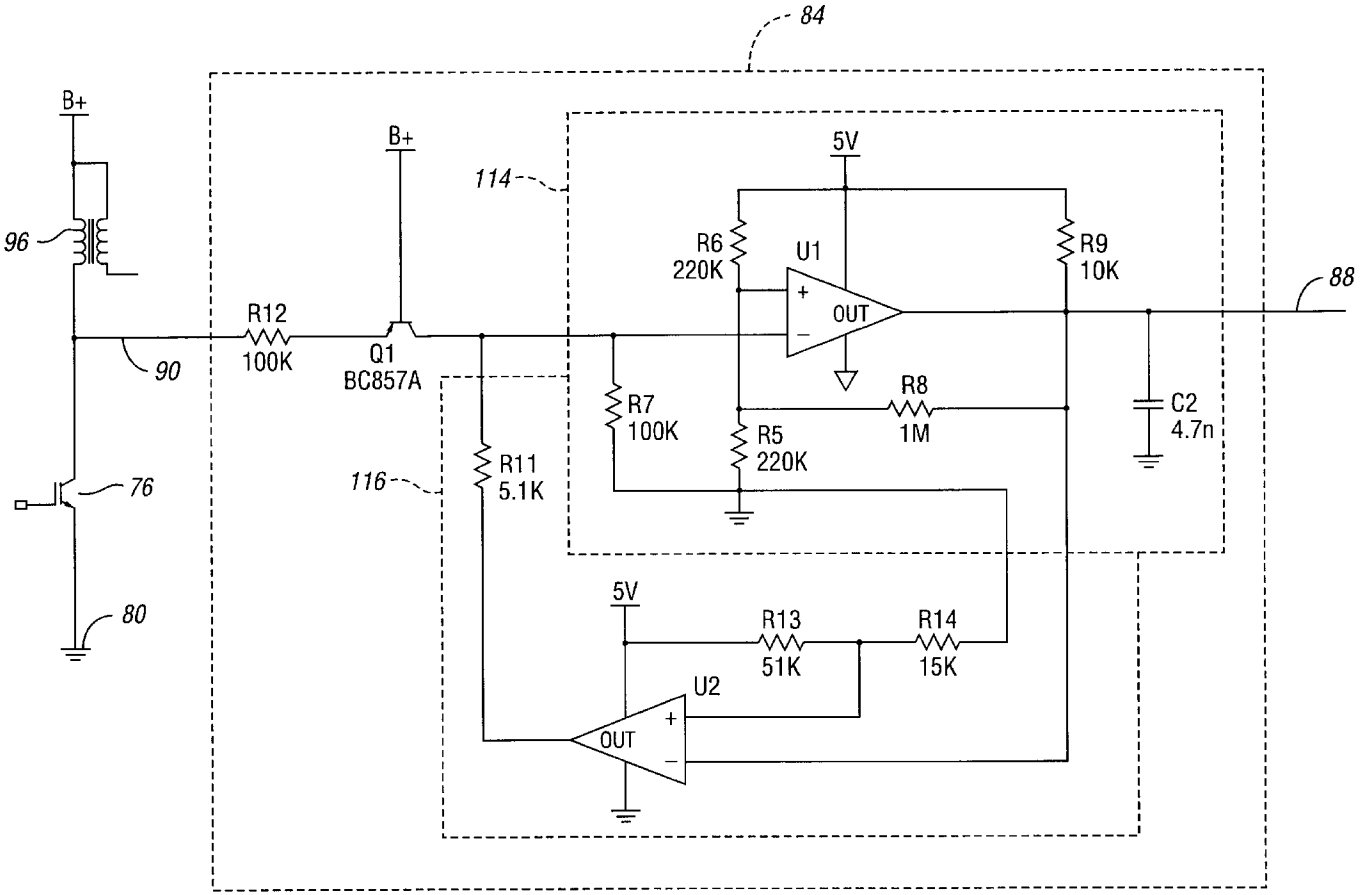
FIG. 6 depicts an example circuit implementing a diagnostic circuit block for the circuit depicted in FIG. 4.

By way of non-limiting example, a diagnostic circuit 84, which determines burn time, is shown in FIG. 6. Voltage detected at input 90 is converted to a current by transistor Q1. The diagnostic data, in the form of a pulse having duration equal to the burn time, appears at the output 88 of comparator stage 114. At the beginning of the burn time 106, the output 88 will initiate a diagnostic pulse due to current flow through R7 and R11. Once the diagnostic pulse is initiated, threshold stage 116 turns off the output of comparator U2, thereby effectively removing R11 from the collector of Q1 and reducing the Q1 collector current needed to keep the output of comparator U1 turned on. The output of U1 therefore remains on for the duration of the burn time and derives diagnostic data from the voltage of the ignition coil primary winding 96. It must be restated that this implementation of a diagnostic circuit 84 is merely an example. Other functions may also be implemented as indicated in this specification.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition coil assembly for providing ignition energy to a spark plug in accordance with a dwell signal, and transmitting diagnostic data related to an ignition event occurring after the dwell pulse, said assembly comprising:

an ignition coil having a primary winding and secondary winding, said secondary winding being connected to a spark plug terminal adapted to mate with the spark plug;

a transistor for conducting current flow through said primary winding, said current flow being in accordance with the dwell pulse arriving over a signal line; and a diagnostic block receiving at least one electrical signal from said primary winding and deriving diagnostic data from said at least one electrical signal, whereby said diagnostic block transmits said diagnostic data over said signal line in the absence of said dwell pulse.

2. The ignition coil assembly of claim 1 wherein said at least one electrical signal is an ignition voltage signal.

3. The ignition coil assembly of claim 1 wherein said at least one electrical signal is an ignition current signal.

4. The ignition coil assembly of claim 1 wherein said diagnostic data is an ignition burn time.

5. The assembly of claim 1 wherein said diagnostic data is transmitted by said diagnostic block over said signal line at a voltage greater than a high voltage of the dwell pulse.

6. The assembly of claim 5 further comprising a charge pump for providing power to said diagnostic block.

7. The assembly of claim 1 further comprising a window comparator with an output for driving said transistor, said window comparator enabling current flow through said transistor while the dwell pulse is at a voltage between an upper voltage threshold and a lower voltage threshold.

8. The assembly of claim 7 further comprising a low-pass filter for preventing current flow through said transistor when the voltage of said signal line traverses through said upper and lower voltage thresholds.

9. A multiplexed ignition system for a spark plug, the system comprising:

an ECM having a microprocessor with an input and an output, said output sending a dwell pulse and said input receiving diagnostic data, and signal line for connecting to an ignition coil assembly, said dwell signal and said diagnostic data travelling across said signal line; and said ignition coil assembly having an ignition coil with a primary winding and a secondary winding, said secondary winding being connected to a spark plug terminal adapted to mate with the spark plug, a transistor for conducting current flow through said primary coil, said current flow being in accordance with said dwell pulse sent across said signal line, and a diagnostic block receiving at least one electrical signal from said primary winding and deriving said diagnostic data from said at least one electrical signal, whereby said diagnostic block transmits said diagnostic data to said ECM across said signal line in the absence of said dwell pulse.

10. The ignition system of claim 9 wherein said at least one electrical signal is an ignition voltage signal.

11. The ignition system of claim 9 wherein said at least one electrical signal is an ignition current signal.

12. The ignition system of claim 9 wherein said diagnostic data is an ignition burn time.

13. The ignition system of claim 9, said ECM further comprising a voltage comparator in series with said microprocessor input, said voltage comparator passing said diagnostic data to said microprocessor input and blocking said dwell pulse from said diagnostic input; and said ignition coil assembly further comprising a charge pump for providing power to said diagnostic block, said diagnostic block transmitting said diagnostic data at a voltage greater than a high voltage of said dwell pulse.

14. The ignition system of claim 9, said ignition coil assembly further comprising a window comparator with an output for driving said transistor, said window comparator enabling current flow through said transistor while said dwell pulse is at a voltage between an upper voltage threshold and a lower voltage threshold.

15. The ignition system of claim 14 further comprising a low-pass filter for preventing current flow through said transistor when the voltage of said signal line traverses through said upper and lower voltage thresholds.

16. An ignition coil assembly for providing ignition energy to a spark plug in accordance with a dwell pulse, said assembly comprising:

an ignition coil having a primary winding and secondary winding, said secondary winding being connected to a spark plug terminal adapted to mate with the spark plug;

a window comparator for receiving the dwell pulse, said window comparator having a high voltage threshold and a low voltage threshold and an output for driving a transistor while the dwell pulse is within the high and low voltage thresholds; whereby said transistor conducts current flow through said primary coil in accordance with said comparator output.

17. The assembly of claim 16 further comprising a low-pass filter for preventing current flow through said transistor when a voltage at an input of said comparator traverses through said upper and lower voltage thresholds.

* * * * *